US005168641A

United States Patent [19]

Smal

[11] Patent Number: 5,168,641

[45] Date of Patent: Dec. 8, 1992

[54] TRAVEL HAIR-DRYER

[75] Inventor: Henri Smal, Blégny, Belgium

[73] Assignee: Continental Products S.A., Valenciennes, France

[21] Appl. No.: 663,102

[22] Filed: Mar. 1, 1991

[30] Foreign Application Priority Data

Mar. 2, 1990 [BE] Belgium ..... 09000241

[51] Int. Cl.[5] ..... A45D 20/00

[52] U.S. Cl. ..... 34/97; 34/96; 392/383; 392/380

[58] Field of Search ..... 34/90, 91, 96, 97, 98, 34/243 R; 392/380, 383, 384, 385, 379

[56] References Cited

U.S. PATENT DOCUMENTS 3,953,710 4/1976 Dyer ..... 34/96
4,556,782 12/1985 Fujishima et al. ..... 34/96
4,701,595 10/1987 Okutsu et al. ..... 34/97

*Primary Examiner*—Henry A. Bennet
*Assistant Examiner*—Denise L. F. Gromada
*Attorney, Agent, or Firm*—Herbert Dubno

[57] ABSTRACT

The travel hair-dryer consists of two telescopic components (1, 2), one of the components (1) being provided at its base with an air inlet grille (6) and comprising the conventional components (3, 4, 5) of a hair-dryer, and the other component (2), sliding over the first component (1), being closed at the top thereof and being provided with a lateral grille (8) for the discharge of air, the said grille being released when the apparatus is extended.

5 Claims, 1 Drawing Sheet

TRAVEL HAIR-DRYER

FIELD OF THE INVENTION

The present invention relates to electrical appliances known as hair dryer and relates to a travel hair-dryer.

OBJECTS OF THE INVENTION

An object of the invention is to provide a hair dryer which is very small and easy to transport.

A further object of the invention is to provide a hair dryer such that it constitutes a means which is suitable to be decorated with advertising material or with material which is simply amusing.

SUMMARY OF THE INVENTION

A hair-dryer according to the invention comprises two telescopic components, one of the components being provided at its base with an air inlet grill and comprising the conventional components of a hair dryer, and the other component, sliding over the first component, being closed at the upper part thereof and being provided with a lateral air outlet grill, the grill being rendered operative when the apparatus is extended.

BRIEF DESCRIPTION OF THE DRAWING

In order to understand the invention better it will be described below on the basis of the attached drawing, given solely by way of example and wherein.

SPECIFIC DESCRIPTION

Figure 3:
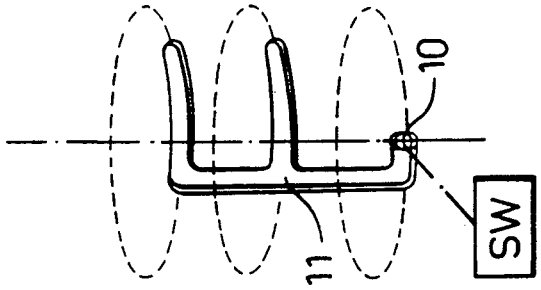
FIG. 3 is a view showing a possible path of the sliding component.

As can be seen in the drawing, the hair dryer consists of two cylinders 1, 2 sliding one into the other. The internal cylinder 1 accommodates the conventional components of a hair dryer, namely a heating resistor 3, motor 4, turbine 5 and a switch (not illustrated).

The internal cylinder 1 is provided at its base with axial, and optionally lateral, apertures 6 which form an air inlet, and is open at the top 7. This internal cylinder 1 is fitted into the external cylinder 2, which comprises in its upper part lateral apertures forming a grill 8 for the discharge of air.

The heating resistor 3 and electric motor 4 are supplied with power by means of a cable 9.

Figure 1:
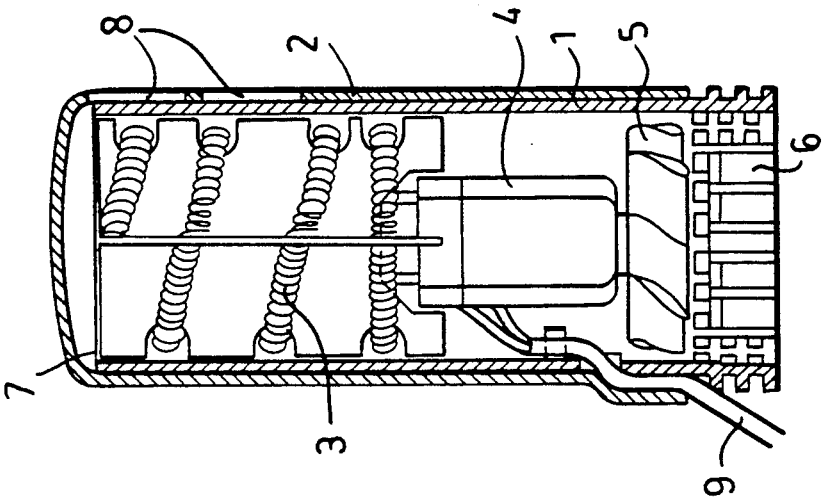
FIG. 1 is a longitudinal section through a hair-dryer according to the invention, in the closed position.

When the two cylinders are completely fitted into one another (FIG. 1), the apparatus is in the rest position and its size is minimal.

Figure 2:
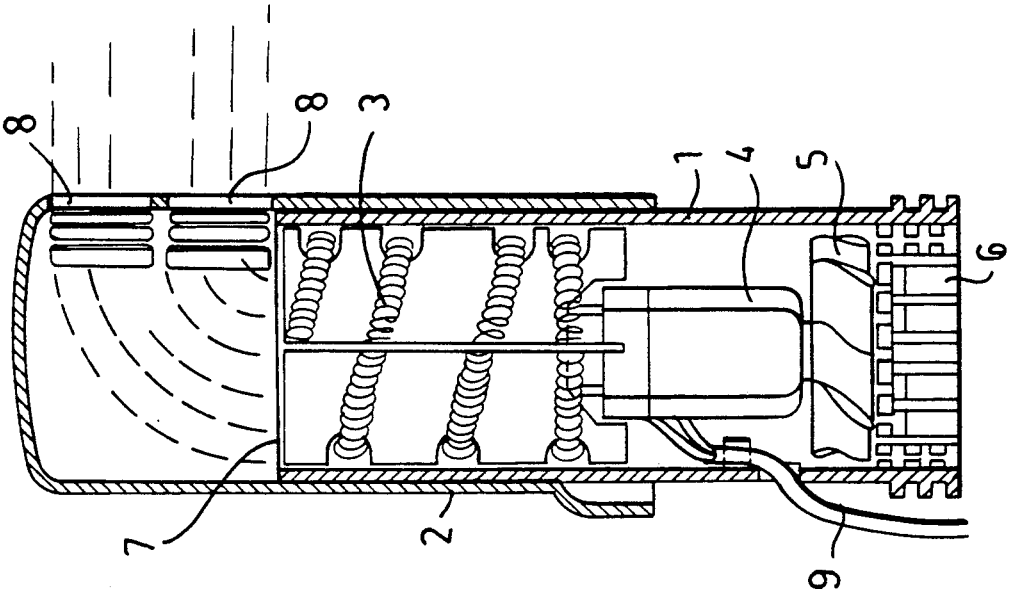
FIG. 2 is a section similar to that of FIG. 1 of the hair dryer in the operating position.

When the external cylinder 2 slides in relation to the internal cylinder 1 (FIG. 2), the grille 8 is rendered operative and the apparatus may be used.

The apparatus may be extended in various ways, optionally with one or a plurality of stages thus making sections of the grill 8 operative to a greater or lesser extent and consequently modifying the emerging air flow. This extension procedure may be controlled in various ways.

For example, the positions of the outer cylinder can be defined by the path of a lug 10 (FIG. 3) secured on one of the cylinders and sliding in a groove 11 hollowed out in the other cylinder. The movements are essentially rotations and translations, the rotational movements, for example, ensuring that the apparatus locks in the closed position and is engaged at different speeds depending on the stages, and the translation movements ensuring that the apparatus is closed and extended, with the outlet grill being opened at one or more levels.

Alternatively, the positions may be defined by the helical displacement of one cylinder in relation to the other or by a ratchet which, when released, for example by pressure on a button, releases one or more springs automatically moving the apparatus into the extended position, the apparatus being closed by axial pressure until it clips into place.

The relative movements of the cylinders, whether these are translational, rotational or helical or a combination of various movements, activate electrical contacts which control the operation at one or more speeds and the stoppage of the apparatus. These contacts may be controlled by one or by separate switches SW (FIG. 3) which the external cylinder returns automatically to the "0" setting when the apparatus is closed for safety reasons. A multivoltage version may be produced by the addition of an electrical or mechanical selector device, and, if a mechanical selector device is used, in particular by directing or blocking the movements within given limits depending on the desired feed voltage.

The cylindrical shape of the hairdryer according to the invention constitutes a device which is particularly well suited to being decorated with advertising, or simply amusing, material.

The above description is provided on the basis of a cylinder of revolution but it is evident that the hairdryer according to the invention may have any cross-section: oval, square, etc.

I claim:

1. A travel hair dryer, comprising:

an inner elongated housing component open at one axial end and formed at an opposite axial end with an air inlet grill;

air heating means between said air inlet grill and said open end in said inner elongated housing component and including:

an electrical heating resistor, an electric motor, and a blower on said motor for displacing air drawn in through said air inlet grill, heating said air at said electrical heating resistor and displacing heated air out of said one end; and an outer elongated housing component telescopingly engaged with said inner housing component and fitted over said open end, said outer elongated housing component having a lateral grill blocked in a contracted relative telescoped position of said housing components and unblocked in an extended relative telescoped position of said housing components to permit discharge of said heated air through said lateral grill in said extended position beyond said open end.

2. The travel hair dryer defined in claim 1, further comprising a switch operatively connected with at least one of said components for controlling said heating means and operated by movement of said components relative to one another.

3. The travel hair dryer defined in claim 1 wherein said components are cylindrical.

4. The travel hair dryer defined in claim 1, further comprising means whereby said components are relatively shiftable into said extended position in stages to modify air flow from said lateral grill.

5. A travel hair dryer, comprising:

an inner elongated cylindrical housing component open at one axial end and formed at an opposite axial end with an air inlet grill;

air heating means between said air inlet grill and said open end in said inner elongated housing component and including:

an electrical heating resistor, an electric motor, and a blower on said motor for displacing air drawn in through said air inlet grill, heating said air at said electrical heating resistor and displacing heated air out of said one end;

an outer elongated cylindrical housing component telescopingly engaged with said inner housing component and fitted over said open end, said outer elongated housing component having a lateral grill blocked in a contracted relative telescoped position of said housing components and unblocked in an extended relative telescoped position of said housing components to permit discharge of said heated air through said lateral grill in said extended position beyond said open end; and means for holding said components in said positions and including a groove having an axially extending segment and a plurality of circumferential segments axially spaced along said axially extending segment and formed in one of said components and a stud guided in said groove on the other of said components.

* * * * *